US007591492B2

(12) United States Patent
Nikkhah

(10) Patent No.: US 7,591,492 B2
(45) Date of Patent: Sep. 22, 2009

(54) LATCH FOR SLIDING DOOR

(75) Inventor: Ali Nikkhah, Mission Viejo, CA (US)

(73) Assignee: Shower Enclosures America, Inc., Ontario, CA (US)

( * ) Notice: Subject to any disclaimer, the term of this patent is extended or adjusted under 35 U.S.C. 154(b) by 0 days.

(21) Appl. No.: 11/736,389

(22) Filed: Apr. 17, 2007

(65) Prior Publication Data

US 2008/0127567 A1 Jun. 5, 2008

Related U.S. Application Data

(60) Provisional application No. 60/868,392, filed on Dec. 4, 2006.

(51) Int. Cl.
*E05C 19/10* (2006.01)
*E05C 3/04* (2006.01)

(52) U.S. Cl. ..... 292/100; 292/121; 292/210; 292/DIG. 46

(58) Field of Classification Search ..... 292/128, 292/228, 100, 95, 121, 126, 108, 219, 226, 292/200, 210, 304, DIG. 46, DIG. 38, DIG. 63
See application file for complete search history.

(56) References Cited

U.S. PATENT DOCUMENTS

| | | | | | |
|---|---|---|---|---|---|
| 2,523,727 | A * | 9/1950 | Sevison | 292/128 |
| 3,050,322 | A * | 8/1962 | Miller | 292/114 |
| 3,161,923 | A * | 12/1964 | Crain | 292/128 |
| 4,106,239 | A * | 8/1978 | Bancroft et al. | 49/449 |
| 4,542,924 | A * | 9/1985 | Brown et al. | 292/87 |
| 4,832,384 | A * | 5/1989 | Venable | 292/87 |
| 5,028,082 | A * | 7/1991 | Kronbetter | 292/128 |
| 6,712,404 | B2 * | 3/2004 | Davies et al. | 292/87 |

* cited by examiner

*Primary Examiner*—Carlos Lugo
*Assistant Examiner*—Alyson M Merlino
(74) *Attorney, Agent, or Firm*—Blakely, Sokoloff, Taylor & Zafman LLP

(57) ABSTRACT

A latch assembly for a sliding door includes a latch base having a generally channel-shaped configuration for receiving the stile of a sliding door and a handle pivotally coupled to the latch base having a lift portion facing outward from the door. When the lift portion is pulled, the door stile is released from the latch base and the door is pushed away from the doorjamb by a tab portion of the handle, both actions occurring substantially simultaneously.

2 Claims, 6 Drawing Sheets

LATCH FOR SLIDING DOOR

CROSS-REFERENCE TO RELATED APPLICATION

This application claims priority of provisional application 60/868,392, filed Dec. 4, 2006.

BACKGROUND OF THE INVENTION

1. Field of the Invention

The present invention relates generally to a latch assembly for sliding doors and, more particularly, to an easily releasable latch for positively securing a sliding door in a closed position as required, for example, in recreational vehicles.

2. Background

Sliding doors are widely used in a variety of applications, such as cabinets, closets and wardrobes. In many instances, it is desirable to secure a sliding door in a closed position. This is particularly true for installations in recreational vehicles, where an unsecured door can pose a safety hazard. While it is important to secure a door in the closed position, it is also desirable to make it convenient to open the door when desired. Thus, a sliding door latch should be easy to operate, preferably with only one hand.

SUMMARY OF THE INVENTION

The present invention provides a two-part latch assembly for a sliding door. A latch base has a generally channel-shaped configuration for receiving the stile of a sliding door. A handle is pivotally coupled to the latch base having a lift portion facing outward from the door. When the lift portion is pulled, the door stile is released from the latch base and the door is pushed away from the doorjamb by a tab portion of the handle, both actions occurring substantially simultaneously.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
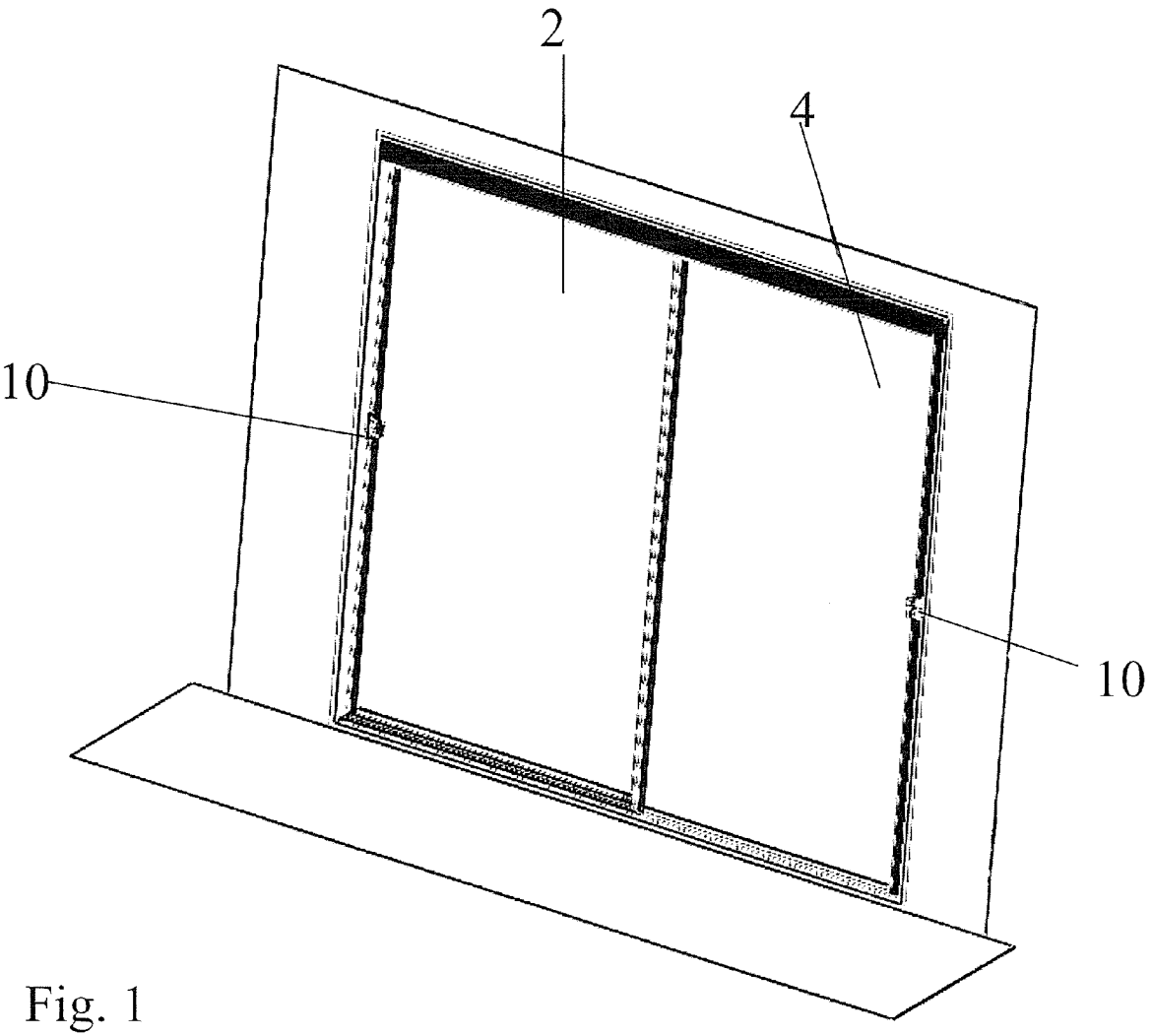
FIG. 1 illustrates an environment in which the present invention may be utilized.

FIG. 1 shows a pair of sliding doors 2, 4 such as might be used for a closet or wardrobe. For many applications, the door panels may be mirrors; however, the invention is not limited in this regard and may be used with any type of sliding panel.

A latch assembly 10 is installed on each side of the doorframe to secure each of the doors in a closed position.

Figure 2:
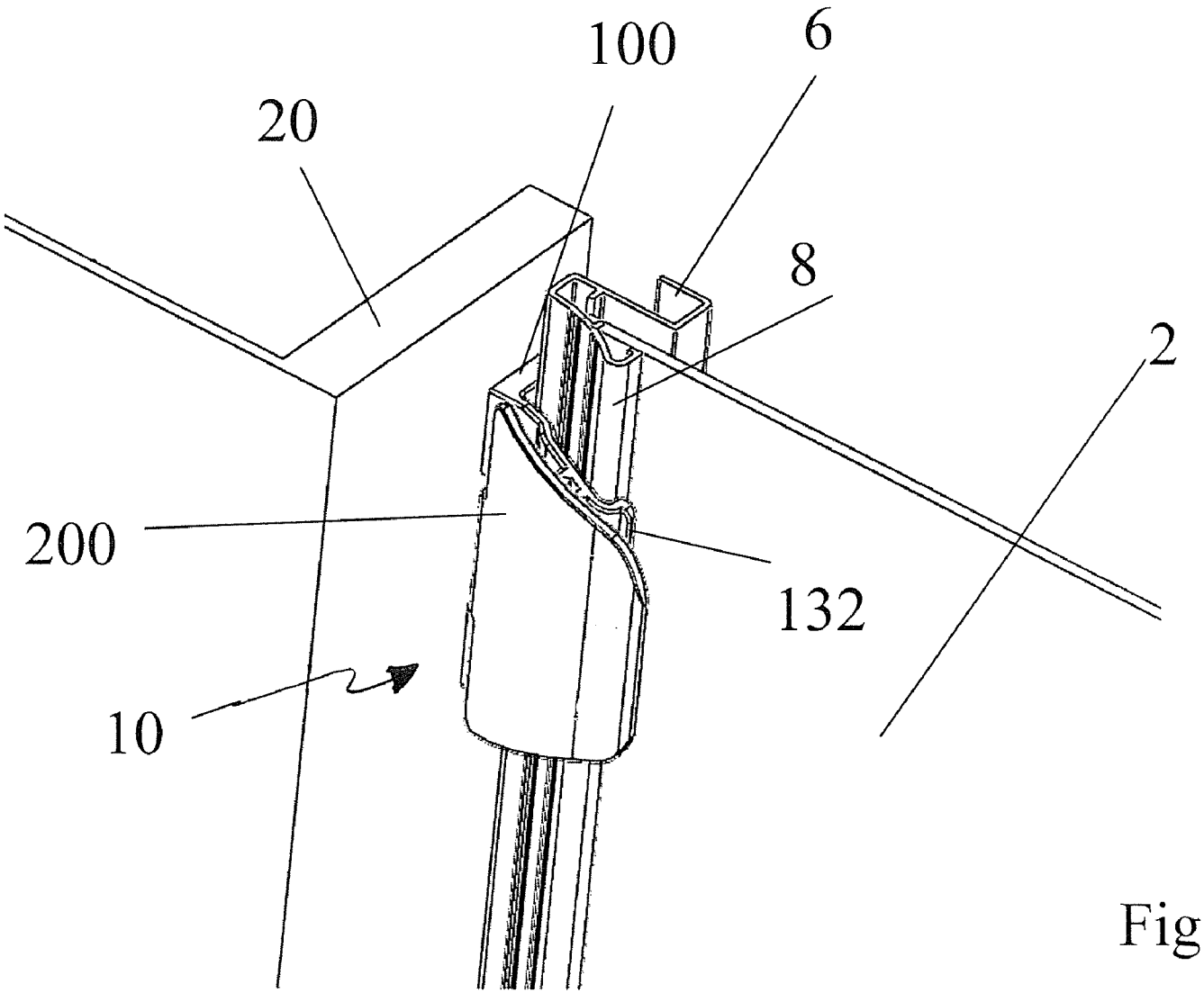
FIG. 2 is a detailed view showing a latch assembly in accordance with the present invention in association with a sliding door.

FIG. 2 is a partial cross-sectional view showing latch assembly 10 securing door 2 in a closed position. Latch assembly 10 comprises a latch base 100, which is secured to doorjamb 20 with screws or other suitable fastening hardware. The latch base includes a catch portion 132 that fits over and retains the protruding lip portion 8 of door stile 6. Latch assembly 10 further comprises handle 200 with which the latch is released as will be described more fully below.

Figure 3:
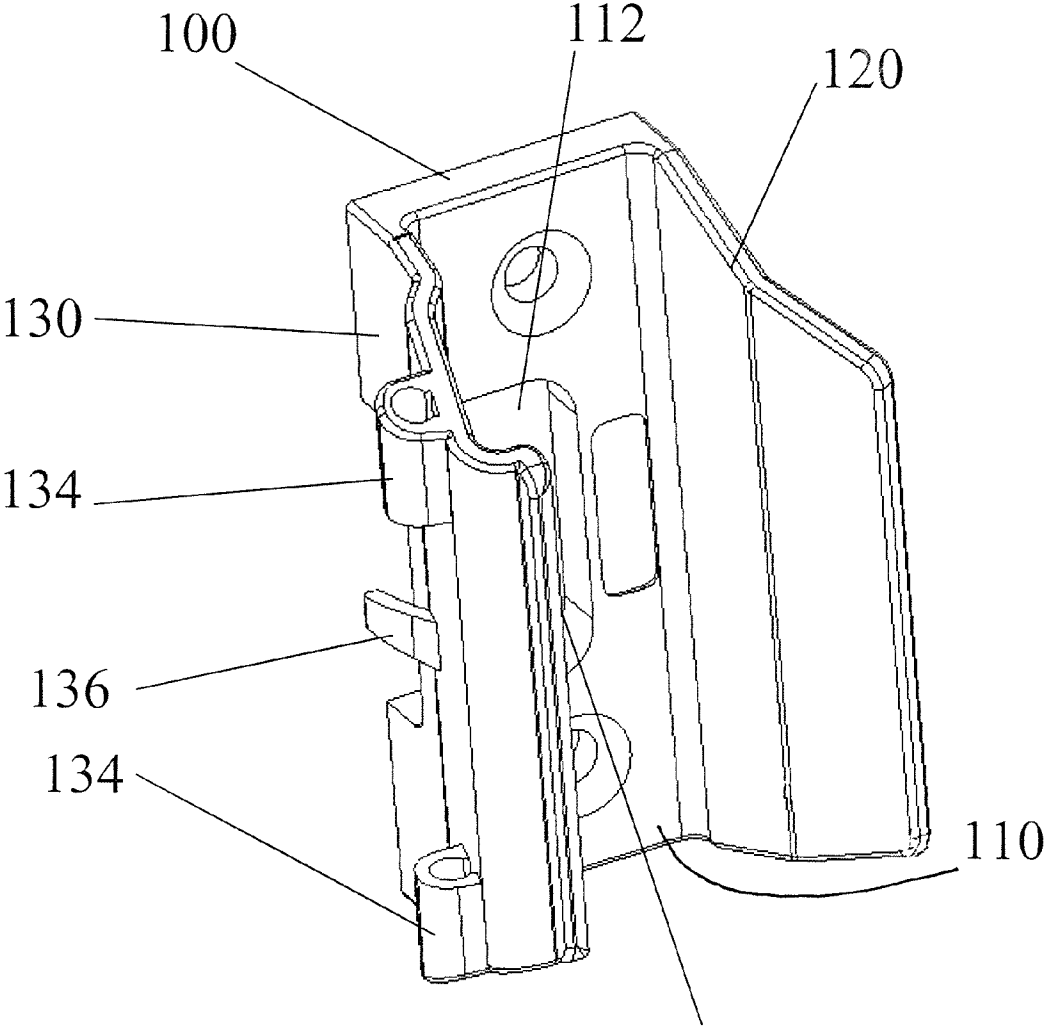
FIG. 3 is a perspective view of a latch base used in the latch assembly shown in FIG. 2.

FIG. 3 is a perspective view of the latch base 100. This component may be made of nylon or other suitable resilient material with shape "memory", including metals and other plastics. The latch base has a generally channel-shaped configuration with a channel bottom portion 110 and channel wall portions 120, 130. Wall portion 130 includes the catch portion 132. Wall portion 130 also includes pivot bearings 134 and spring member 136, the functions of which will be described below. Channel bottom portion 110 includes an aperture 112, the function of which will also be described below.

Figure 4:
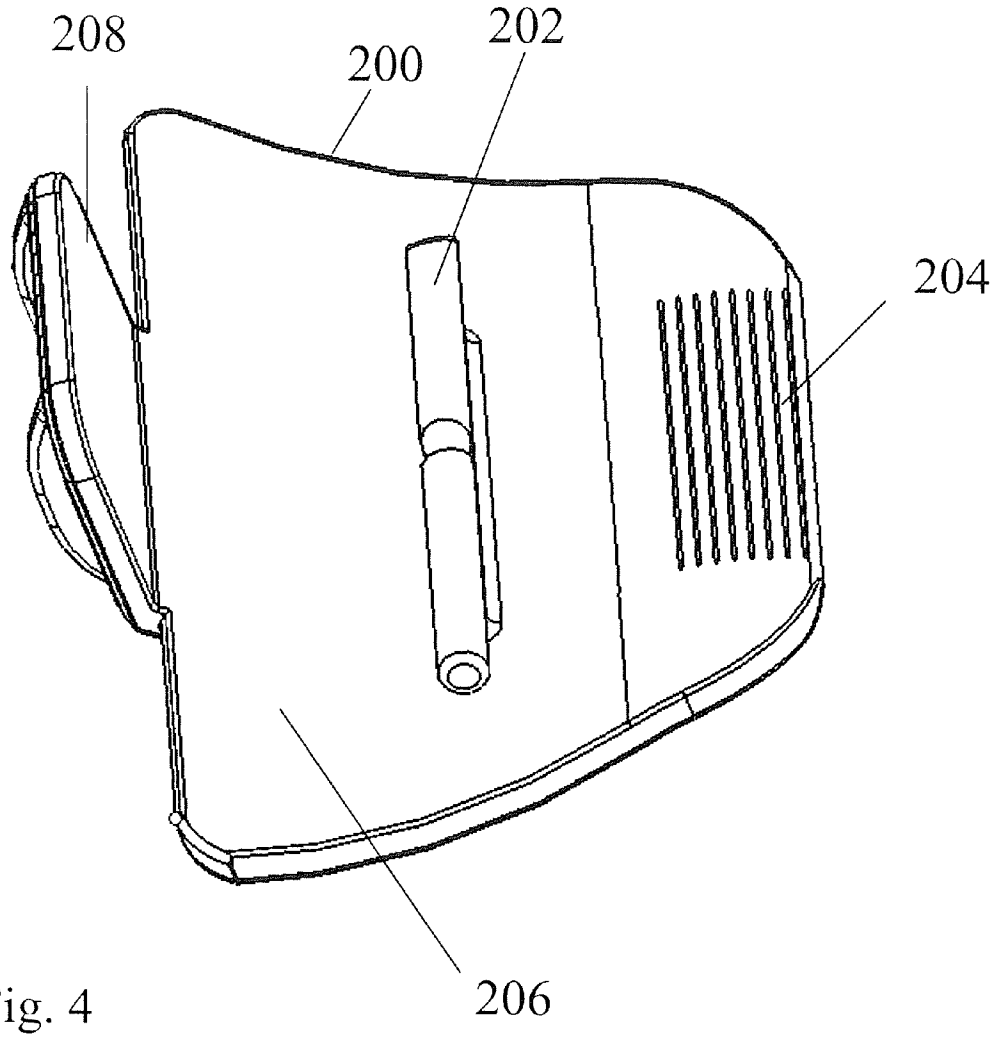
FIG. 4 is a perspective view of a latch handle used in the latch assembly shown in FIG. 2.

FIG. 4 is a perspective view of handle 200. This component may be made of aluminum or other suitable metal or be made of a suitable plastic. Handle 200 includes pivot pin 202, lift portion 204, bearing surface 206 and tab portion 208.

Figure 5:
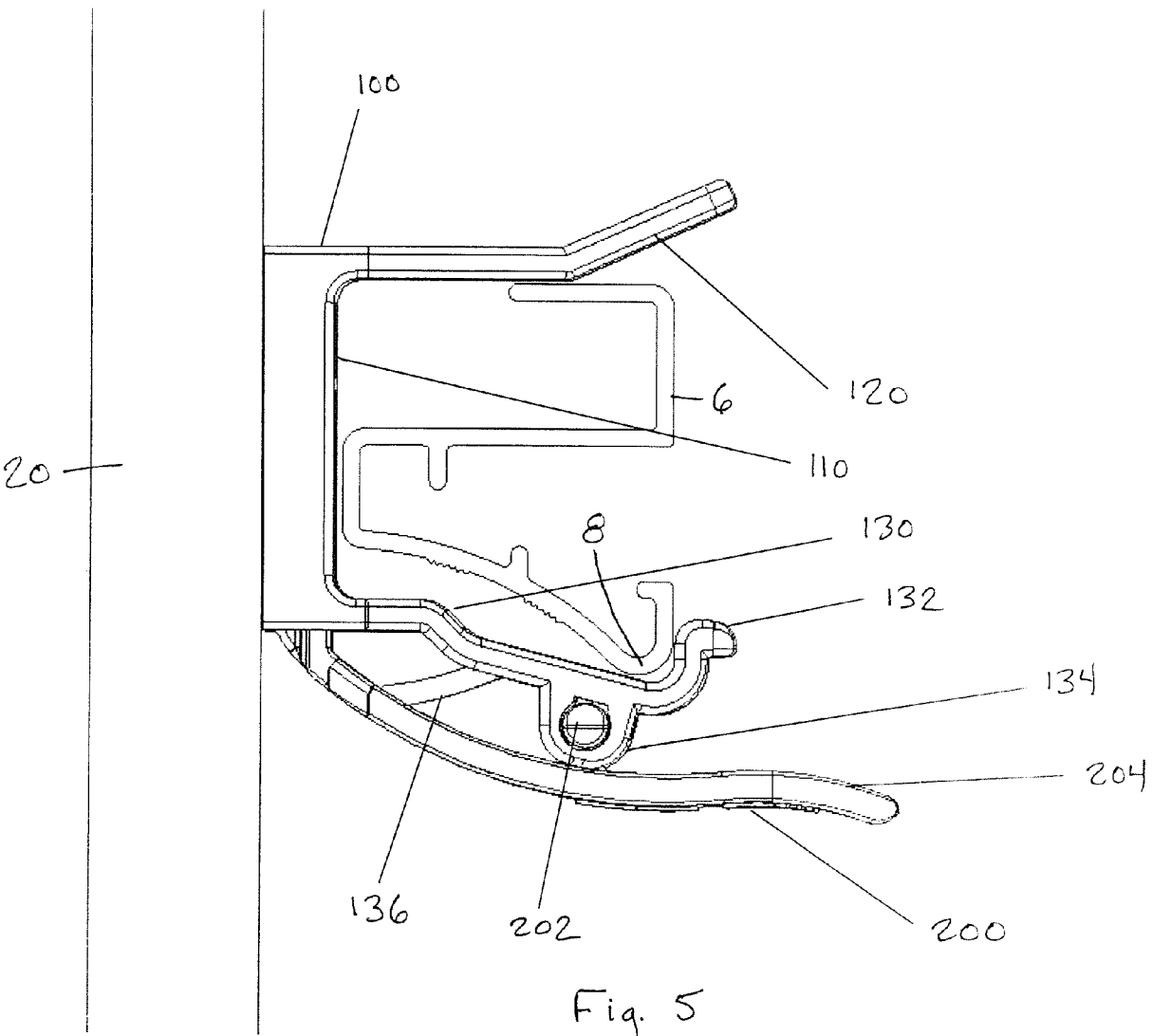
FIG. 5 illustrates the latch assembly in a "closed" position.

Referring now to FIG. 5, an assembled latch assembly 10 comprising latch base 100 and handle 200 is shown. To assemble the components, one side of pivot pin 202 is inserted into the corresponding pivot bearing 134 and the handle is slid to the side of the latch base as far as it will go. At this point, the other end of pivot pin 202 can be inserted into the other pivot bearing and the handle can then be centered on the latch base. The handle remains centered on the latch base as a result of the tab portion 208 being disposed within aperture 112.

FIG. 5 shows latch assembly 10 in a "relaxed" or "closed" condition. Wall portions 120 and 130 are angled outwardly to receive the stile of a sliding door. When the door is pushed toward the channel bottom portion 110, wall portions 120 and 130 spring outward until the protruding portion 8 of the door stile 6 is captured by catch portion 132 with the door stile 6 resting proximate to the doorjamb as shown in FIG. 2. Spring member 136 rests against the bearing portion 206 of handle 200, but remains in a relaxed condition in the configuration shown in FIG. 5.

Figure 6:
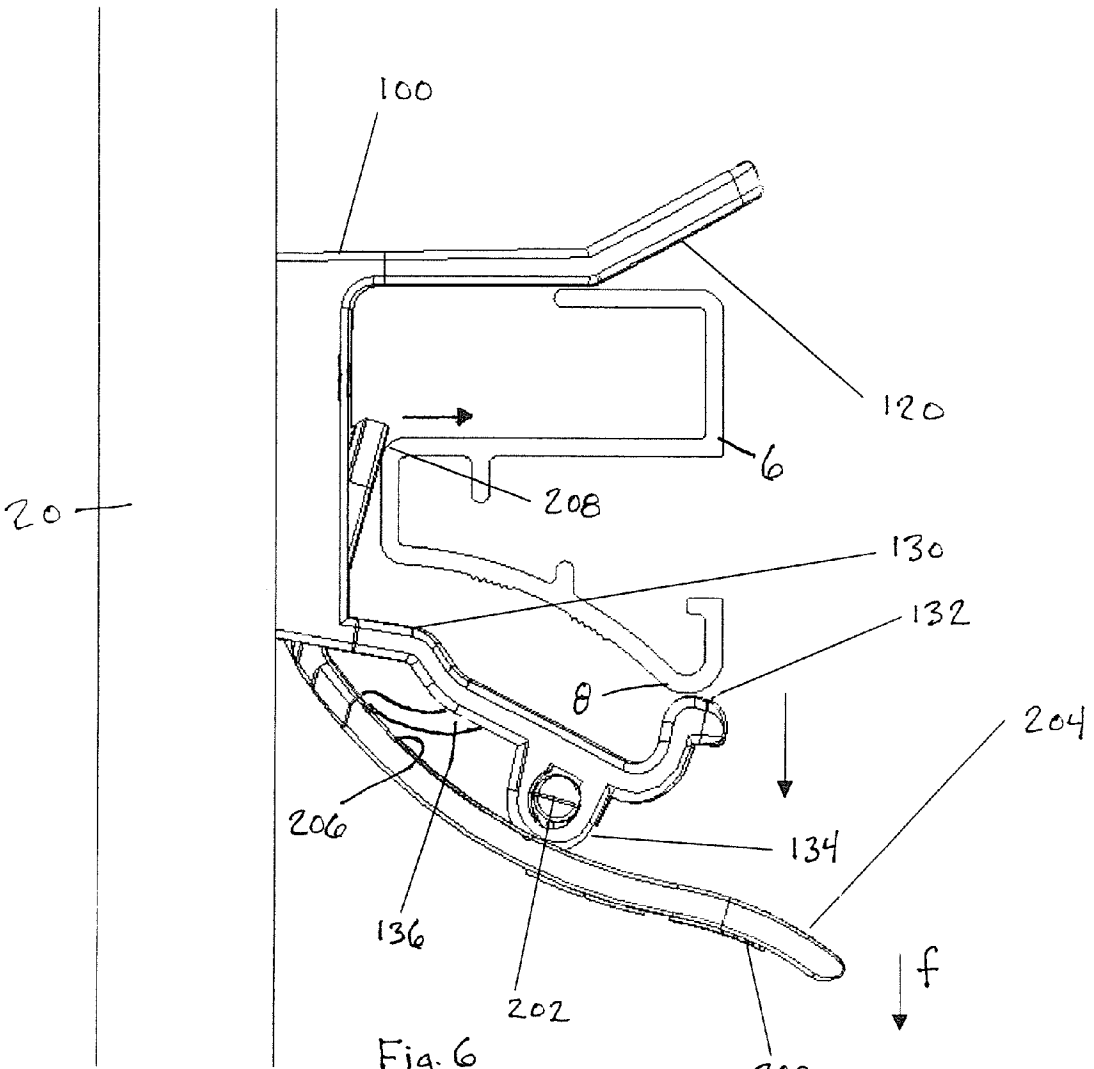
FIG. 6 illustrates the latch assembly in an "open" position.

Referring now to FIG. 6, latch assembly 10 is shown in a "flexed" or "open" condition as a result of applying a lifting force f to the lift portion 204 of handle 200. This causes the handle to initially rotate about pivot pin 202 causing the bearing surface 206 to deflect spring member 136. Continued application of the lifting force draws wall portion 130 outward, releasing the door stile from catch portion 132. At the same time, tab portion 208 rotates and contacts door stile 6 to urge the door stile away from the channel bottom portion 110 so that when lifting pressure on the handle is released, the door stile is free of catch portion 132. Thus, the catch is released and the door is pushed to an unsecured position by a single operation using one hand.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. A latch assembly for a sliding door having a stile along an edge thereof, the latch assembly comprising:

a latch base comprising a channel bottom portion and first and second channel wall portions defining a channel configured to receive the stile of the sliding door, the first channel wall portion having a catch portion adapted to engage the stile and hold the stile within the channel with the stile seated against the channel bottom portion, a pivot bearing portion and a spring member protruding from the first channel wall portion;

a handle pivotally coupled to the latch base at the pivot bearing portion, the handle having a lift portion generally parallel to the first channel wall portion of the latch base, a tab portion and a bearing surface, the bearing surface disposed for operative engagement with the spring member of the latch base, the latch base and handle configured so that, when the lift portion is pulled outwardly away from the latch base, (i) the bearing surface bears against the spring member, thereby pulling the first channel wall portion outwardly and disengaging the catch portion from the stile and (ii) the tab portion rotates through an aperture in the channel bottom portion to push the stile out of the channel.

2. A sliding door assembly comprising:

a sliding door having a stile along an edge thereof;

a latch base secured to a doorjamb, the latch base having a channel bottom portion and first and second channel wall portions defining a channel configured to receive the stile of the sliding door, the first channel wall portion having a spring member protruding therefrom and a catch portion configured to retain the stile in a closed position seated against the channel bottom portion;

a handle pivotally coupled to the latch base, the handle having a lift portion and a tab portion, the handle operatively engaging the latch base such that, when the handle is operated to pivot with respect to the latch base by lifting the lift portion in a direction substantially perpendicular to the sliding door, the handle bears against the spring member, the stile of the sliding door is released from the catch portion and the tab portion bears against the stile of the sliding door to urge the stile out of the channel and away from the doorjamb.

* * * * *